US006390931B1

(12) United States Patent
Berndt

(10) Patent No.: US 6,390,931 B1
(45) Date of Patent: May 21, 2002

(54) APPARATUS AND METHOD FOR GOLF CLUB PROTECTION

(76) Inventor: Timothy R. Berndt, 8541 Broadway Rd., Wolcott, NY (US) 14590

( * ) Notice: Subject to any disclaimer, the term of this patent is extended or adjusted under 35 U.S.C. 154(b) by 0 days.

(21) Appl. No.: 09/587,424

(22) Filed: Jun. 5, 2000

Related U.S. Application Data

(60) Provisional application No. 60/137,712, filed on Jun. 7, 1999.

(51) Int. Cl.[7] ..... A63B 57/00

(52) U.S. Cl. ..... 473/282; 248/156; 248/688

(58) Field of Search ..... 473/282; 43/21.2; 211/70.2; D21/796; D6/552; 248/530, 688, 156

(56) References Cited

U.S. PATENT DOCUMENTS 4,210,334 A * 7/1980 Lind
4,545,579 A * 10/1985 McCain
4,805,911 A * 2/1989 Ferlazzo
4,862,970 A * 9/1989 Hlavacek
5,686,158 A * 11/1997 Gibbon
5,730,404 A * 3/1998 Evans
5,743,276 A * 4/1998 Tamayo-Rivera
5,782,443 A * 7/1998 La Fontaine
5,813,414 A * 9/1998 Zutler
5,890,970 A * 4/1999 Donati

* cited by examiner

*Primary Examiner*—Stephen Blau

(57) ABSTRACT

A golf club includes an assembly that can be contained within the shaft of the golf club or can extend from the shaft of the golf club. The assembly includes a tine support and a tine attached to the tine support. When the assembly is within the shaft, the tine is positioned against the tine support. When the assembly extends from the shaft, the golf club can be positioned with the tine inserted into the ground. The insertion of the tine into the ground prevents the grip of the golf club from coming in contact with the ground. The tine and the tine support can be engaged by an insert structure, the insert structure being attached to the interior of the golf club shaft.

10 Claims, 2 Drawing Sheets

APPARATUS AND METHOD FOR GOLF CLUB PROTECTION

This application claims the benefit of U.S. Provisional Application No. 60/137,712, filed Jun. 7, 1999.

BACKGROUND OF THE INVENTION

1. Field of the Invention

This invention relates generally to the game of golf and, more particularly, to protecting the golf club grip from being compromised with foreign matter during a game.

2. Description of the Related Art

During the playing of golf, the rules frequently prohibit the carrying of bags on selected parts of the golf course, such as the greens area around the hole. In this situation, the general procedure is to carry a few clubs to the playing area and to select the most appropriate club for execution of the stroke. The unselected clubs are typically placed on the ground during the execution of the stroke.

As will be clear, the placing of the clubs on the ground can adversely impact the future effectiveness of the clubs. Not only can dirt adhere thereto, but water also can become attached to the club and particularly the grip of the clubs. Any foreign matter on the grip can compromise the effectiveness of a future stroke with the club.

In order to remove the foreign matter on the grip of the golf club, a towel or similar article can be provided to wipe the foreign matter from the grip after contact with the ground. This solution to the problem is not completely satisfactory. The grip material frequently has a structure imposed thereon to insure that the grip can be firmly handled. This same structure can make it difficult to remove the foreign material once attached to the grip.

A need has therefore been felt for an apparatus and for an associated method for preventing foreign materials from becoming attached to the grip of a golf club. It is a feature of the present invention to provide an apparatus and an associated method for preventing the grip of a golf club from coming in contact with the ground. It is a further feature of the present invention that the apparatus for preventing contact with the ground be a part of the golf club. It is yet another feature of the present invention that the apparatus for preventing contact with the ground not interfere with the use of the golf club during the striking of the golf ball.

SUMMARY OF THE INVENTION

The aforementioned and other features are accomplished, according to the present invention, by providing an assembly that can be stored within the shaft of the golf club. When the use of the assembly is required, the assembly can be partially withdrawn from the shaft. The assembly includes a tine support with a tine attached thereto. The position of the tine, when the tine support is within the shaft, is generally parallel to the tine support. When the tine support is extended from the interior of the shaft of the golf club, the tine is moved from a position parallel to the tine support to a position generally perpendicular to the tine support. The assembly can also include an insert structure that is positioned on the interior of the shaft in the region of the grip. The tine support and the tine can then be enclosed by or partially removed from the insert structure.

BRIEF DESCRIPTION OF THE DRAWINGS

The present invention may be better understood, and its numerous objects, features, and advantages made apparent to those skilled in the art by referencing the accompanying drawings wherein depicted elements are not necessarily drawn to scale and wherein like or similar elements are designated by the same reference numerals throughout the several views.

FIG. 8A is a side view of the tine rod and the tine collapsed configuration capable of being advantageously used in the present invention, while

DETAILED DESCRIPTION OF THE PREFERRED EMBODIMENT(S)

Detailed Description of the Figures

Figure 1:
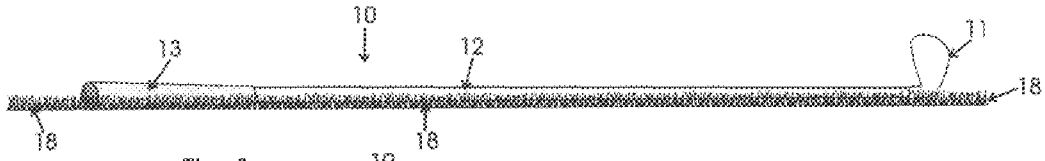
FIG. 1 illustrates a golf club lying on the ground.

Referring now to FIG. 1, a golf club 10, lying on the ground in the manner of the prior art is shown. The golf club 10 includes a head 11, a shaft 12 and a grip 13. The shape of the head 11 will determine the orientation of the golf club 10 when the club is lying on the ground. Grass and/or foliage 18 along with ground 19 can come in contact with the grip 13 of the golf club 10 and deposit foreign matter on the grip 13.

Figure 2:
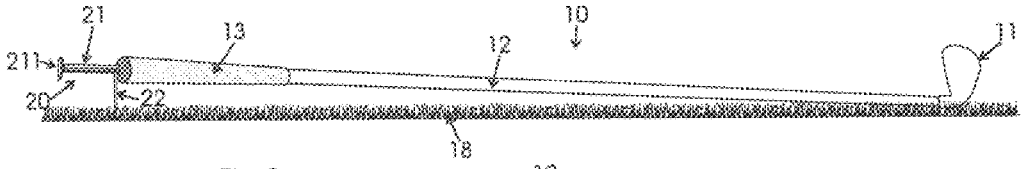
FIG. 2 illustrates a golf club lying on the ground according to the present invention.

Referring now to FIG. 2, a golf club 10 lying on the ground according to the present invention is shown. As will be seen, the head 11 is in contact with the ground and can provide the same golf club orientation as shown in FIG. 1. Assembly 20 has been partially withdrawn from the interior of grip 13. In the embodiment shown in FIG. 2, the assembly 20 includes a tine support 21 and a tine 22. The tine 22 has been rotated from a collapsed configuration proximate to tine support 21 to an expanded configuration with one end of the tine 22 extending away from tine support 21. The tine 22 in the ground is to maintain the grip for the golf club above the grass/foliage 18 and the ground 19. In this manner, foreign matter from the grass/foliage 18 and/or the ground 19 is less likely to come in contact with and adhere to the grip 13. The tine support 21 includes a tine 20 support head 211.

Figure 3:
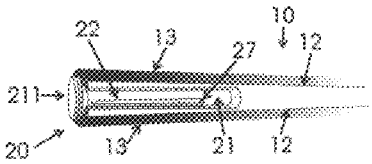
FIG. 3 is a cross-sectional view of the grip of a golf club when the assembly, according to one embodiment of the present invention, is within the golf club shaft.

Referring to FIG. 3, a cross-sectional view of one embodiment of the assembly 20 of the present invention, when the assembly 20 is positioned within the shaft 12 of a golf club, is shown. The assembly 20 includes a tine support 21 and a tine 22. When the assembly 20 is entirely within the shaft 12 of the golf club, the tine 22 is positioned in a collapsed configuration and is proximate the tine support 21. Tine 22 is rotatably coupled to the tine support 21 by pin 27. However, when the assembly is enclosed by the shaft 12, the relative dimensions of the interior surface of shaft 12, the tine support 21, and the tine 22 force the tine 22 to be in a collapsed configuration relative to the tine support 21. Indeed, the tine 22 will be forced into the collapsed configuration with respect to tine support 21 when the assembly 20 is inserted entirely onto the shaft 12.

Figure 4:
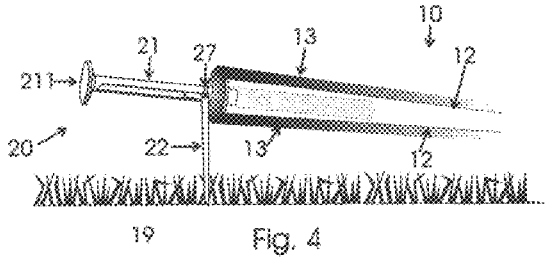
FIG. 4 is a cross-section view of the grip of a golf club when the assembly of the invention has been extended beyond the shaft of the golf club.

Referring to FIG. 4, a cross-sectional view of the embodiment of assembly 20 according to the present invention, when a portion of the tine support 21 is removed from shaft 12. When a sufficient length of the tine support 21 is removed from the shaft 12, then the tine 22, which pivots about pin 27, will have an expanded configuration in which the tine 22 is positioned at an angle of approximately 90° with respect to the tine support 21. Note that in this position, the tine 22 can be forced into the ground 19. As will be described below, the tine 22 can be coupled to tine support 21 in such a way as to be spring-loaded, the spring forcing the tine 22 into the expanded configuration when not confined by the shaft 12.

As will be clear, the assembly 20 (and the shaft 12) shown in FIG. 3 and FIG. 4 can be provided with structure to prevent the tine support 21 and the tine 22 from being completely withdrawn from the interior of the shaft 12. In addition, structure can be provided between a head structure 211 of the tine support 21 and the shaft 12 and/or grip 13 to prevent movement of the assembly 20 when the golf club 10 is used to strike a golf ball.

Figure 5:
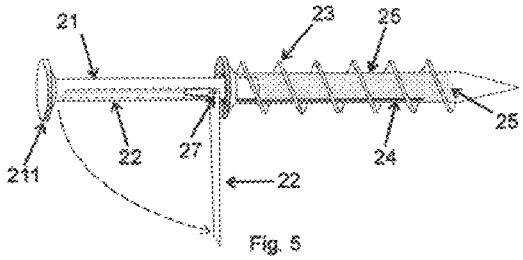
FIG. 5 is a cross-sectional view illustrating the assembly according to a second embodiment of the present invention, wherein the tine support and the tine are extended from an assembly insert structure.
Figure 6:
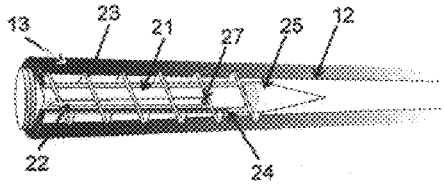
FIG. 6 is a cross-sectional view illustrating the assembly according to the second embodiment of the present invention when the assembly is positioned in a golf club and wherein the tine rod and the tine are positioned in the assembly insert.

Referring to FIG. 5 and FIG. 6, a second embodiment of the assembly 20 of the present invention is shown. In this embodiment, an insert structure 25 is provided. The insert structure 25, rather than the interior of the golf club shaft 12, provides containment for the tine support 21 and the tine 22 as shown in FIG. 6. In FIG. 5, the tine support 21 has been sufficiently removed from the insert structure 25 to permit the tine to pivot about the pin 27 and achieve the expanded configuration. The expanded and the collapsed configurations are determined by the relative position of the tine support 21 and the insert structure 25 rather than the relative position of the tine support 21 and the shaft 13. In FIG. 6, the positioning of the insert structure 25 relative to the shaft 12 and grip 13 is shown. In this positioning, the head 211 of the tine support 21 will generally be in contact with the grip 13 and/or the shaft 12 when the tine support 21 is essentially completely enclosed by the insert structure. Threads 23 can be attached to the insert structure 25, the threads 23 serving to secure the insert structure 25 with respect to the shaft 12. In addition, in FIGS. 5 and 6, a slot 24 is illustrated in the insert structure 25. This slot 24 is meant to engage a protuberance (not shown) of the tine support 21. This structural engagement limits the orientation of the tine support 21 with respect to the insert structure 25 and ultimately determines the orientation of the expanded tine 22 configuration with respect to the golf club. In addition, this structural engagement established the limits of travel of the tine support 21, i.e., prevents the tine support structure form being inadvertently removed form the insert structure 25.

Figure 7A:
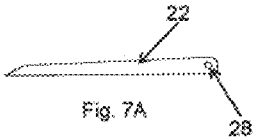
FIG. 7A is a side view of an embodiment of a tine suitable for use with the present invention.
Figure 7B:
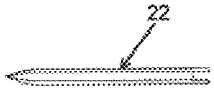
FIG. 7B is a top view of the embodiment of the tine.
Figure 7C:
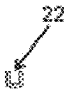
FIG. 7C is an end view of the embodiment of the tine.

Referring to FIG. 7A, FIG. 7B, and FIG. 7C, a side view, a top view, and an end view, respectively, are shown for an embodiment of the tine 22. Aperture 28 is provided for insertion of the pin about which the tine 22 rotates with respect to tine support 21.

Figure 8A:
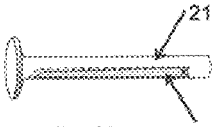
Figure 8B:
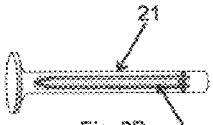
FIG. 8B is a top view of the tine rod and tine collapsed configuration.

Referring to FIG. 8A and FIG. 8B, a side view and a top view, respectively, illustrating the relative positions of the tine support 21 and the tine 22 in the collapsed position is shown.

Figure 9:
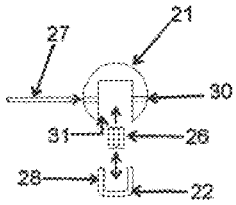
FIG. 9 is an exploded, cross-sectional, end view of the tine rod and tine collapsed configuration illustrating the relationship between these components.

Referring to FIG. 9, an exploded end-view illustrating the coupling of the tine 22 to the tine support 21. The tine support 21 has an aperture 30 formed therein and a groove 31 into which the tine 22 can be placed. Pin 27 is inserted into one portion of the tine support aperture 30, one portion of tine aperture 28, through a spring 26, through a second portion of the tine aperture 28, and through a second portion of aperture 30. The spring 26 is structured to provide a force for extending the tine 22 into the expanded configuration with respect to tine support 21.

Operation of the Preferred Embodiment(s)

The operation for the present invention provides a technique for preventing the grip of a golf club from becoming compromised through contact with the ground. When the tine support is extended from the shaft of the golf club, the action of the spring will automatically force the tine to deploy at an angle to the tine support. Similarly, as the insert rod is repositioned within the shaft, the tine will be forced into a collapsed configuration generally proximate and parallel to the tine support. When not in use, the tine support and the tine do not interfere with the normal use of the golf club.

The embodiment shown in FIG. 5 and FIG. 6 is particularly convenient for adding the assembly of the present invention to golf clubs that already have grips attached. The threads will draw assembly into grip through existing hole in butt end of the grip when rotated clockwise. The threads can be made of material that is sufficiently rigid to provide a strong attachment to the interior walls of the shaft, while having sufficient structural flexibility to be used with golf club shafts of differing dimensions.

The description of the invention set forth herein is illustrative, and is not intended to limit the scope of the invention as set forth in the following claims. Variations and modifications of the embodiment disclosed herein, may be made based on the description set forth herein, without departing from the scope and spirit of the invention as set forth in the following claims.

What is claimed is:

1. A golf club comprising:

a head;

a shaft coupled to the head; and an assembly slidably adapted to fit in the shaft, the assembly including;

a tine support, a tine attached to the assembly, the tine positioned against the tine support when the tine support is within the shaft, the tine extending at an angle from the tine support when the tine support extends a preselected distance from the shaft, and a spring, the spring providing a force rotating the tine with respect to the tine support.

2. The golf club as recited in claim 1 wherein the tine is rotatably attached to the tine support.

3. The golf club as recited in claim 1 wherein, when the assembly is extended with respect to the shaft, the tine is inserted in the ground, the insertion of the tine in the ground preventing the grip from coming in contact with the ground.

4. The golf club as recited in claim 1 wherein the assembly further includes an insert structure, the insert structure attached to the interior of the golf club shaft, the tine support being movable with respect to the insert structure.

5. A method of preventing the contact of the grip for a golf club with the ground when the golf club is lying on the ground, the method comprising:

providing an assembly in the shaft of the golf club, the assembly including a tine support, an attached tine and a spring providing a force to rotate the tine with respect to the tine support;

extending at least a preselected length of the tine support from the shaft; and positioning the tine to extend from the tine support.

6. The method as recited in claim 5 further comprising:

inserting tine in the ground to prevent the grip from touching the ground.

7. The method as recited in claim 5 wherein the tine is rotatabley attached to the tine support.

8. An assembly for use with a golf club, the assembly comprising:

a tine support, the tine support positioned within the shaft of the golf club, the tine support capable of having a portion thereof extend from the shaft;

a tine attached to the tine support, the tine positioned proximate to the tine support when the tine support is within the shaft, the tine extending at an angle from the tine support when the tine support has at least a preselected portion extending from the shaft; and a spring, wherein said spring providing a force rotating the tine with respect to the tine support.

9. The assembly as recited in claim 8 wherein the assembly further comprises an insert structure, the insert structure attached to the interior of the shaft, the tine support structure to move relative to the insert structure.

10. The assembly as recited in claim 8 wherein the tine is inserted into the ground to prevent the grip from coming in contact with the ground.

* * * * *